US009616685B2

(12) United States Patent
Oyanagi

(10) Patent No.: US 9,616,685 B2
(45) Date of Patent: Apr. 11, 2017

(54) RECORDING APPARATUS

(71) Applicant: Seiko Epson Corporation, Tokyo (JP)

(72) Inventor: Takashi Oyanagi, Kamo (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/503,725

(22) Filed: Oct. 1, 2014

(65) Prior Publication Data

US 2015/0092000 A1 Apr. 2, 2015

(30) Foreign Application Priority Data

Oct. 2, 2013 (JP) ..... 2013-207082

(51) Int. Cl.
*B41J 11/00* (2006.01)

(52) U.S. Cl.
CPC ..... *B41J 11/007* (2013.01)

(58) Field of Classification Search
CPC ..... G03G 15/0189; G03G 15/1615; G03G 15/2053; G03G 2215/00139; B41J 13/08; B41J 15/048
See application file for complete search history.

(56) References Cited

U.S. PATENT DOCUMENTS 5,966,145 A * 10/1999 Miura ..... B41J 2/1721 347/33
6,672,705 B2 * 1/2004 Kitahara et al. ..... 347/42
8,308,198 B2 * 11/2012 Udagawa et al. ..... 283/92
2008/0012924 A1 * 1/2008 Moriyama ..... B41J 2/04 347/112
2009/0203834 A1 * 8/2009 Hiraoka ..... B41J 2/0057 524/560
2010/0009182 A1 * 1/2010 Kato et al. ..... 428/355 RA

FOREIGN PATENT DOCUMENTS

JP 2005-029718 A 2/2005
JP 2007-237704 A 9/2007

* cited by examiner

*Primary Examiner* — An Do
*Assistant Examiner* — Renee I Wilson
(74) *Attorney, Agent, or Firm* — Harness, Dickey & Pierce, P.L.C.

(57) ABSTRACT

A recording apparatus includes an endless belt that transports a recording medium by supporting a first surface of a tape-like recording medium on a support surface; and a recording head that performs recording by ejecting ink on a second surface that is an attachment surface coated with an adhesive on the opposite side to the first surface of the recording medium transported by the endless belt.

10 Claims, 5 Drawing Sheets

RECORDING APPARATUS

BACKGROUND

1. Technical Field

The present invention relates to a recording apparatus.

2. Related Art

In the related art, an ink jet-type recording apparatus that records on a recording medium by ejecting ink is used. Among these, for example, JP-A-2007-237704 discloses a recording apparatus that uses an adhesive tape as a recording medium.

In the recording apparatus of the related art, such as disclosed in JP-A-2007-237704, that performs recording by ejecting ink to the tape-like recording medium, a fixing member is used that includes a planar support surface, referred to as a so-called platen, on a medium support portion provided at a position facing the recording head that ejects ink.

However, the tape-like recording medium bends easily, and thereby is easily deformed. Therefore, the recording apparatus of the related art, such as disclosed in JP-A-2007-237704, that performs recording by ejecting ink on the tape-like recording medium has a low transport precision of the recording medium.

SUMMARY

An advantage of some aspects of the invention is to provide a recording apparatus able to transport a tape-like recording medium with high transport precision while suppressing bending and deformation thereof, and perform recording on the recording medium.

According to an aspect of the invention, there is provided a recording apparatus including an endless belt that transports a recording medium by supporting a first surface of a tape-like recording medium on a support surface; and a recording head that performs recording by ejecting ink on a second surface that is an attachment surface coated with an adhesive on the opposite side to the first surface of the recording medium transported by the endless belt.

It is preferable that the support surface be an adhesive surface.

It is preferable that the endless belt be suspended on a plurality of rotary bodies, at least one of the plurality of rotary bodies be a driving roller, and the endless belt move due to torque of the driving roller.

It is preferable that the recording apparatus further include a delivery portion that delivers the recording medium to the endless belt; and a recovery portion that recovers the recording medium from the endless belt, in which the delivery portion, the endless belt, and the recovery portion are able to move relative to constituent members inside the recording apparatus.

It is preferable that the endless belt be suspended on a plurality of rotary bodies, and include a heater that heats between the plurality of rotary bodies to 60° C. or less.

It is preferable that the endless belt be suspended on a plurality of rotary bodies, and include a pressing portion that presses the recording medium to the endless belt with wind power or a silicon roller at a position that faces the rotary bodies with the endless belt interposed.

It is preferable that the recording apparatus further include an ionizer on the upstream side of the recording head in the transport path of the recording medium.

It is preferable that the adhesive coated on the second surface contain at least one of an acrylic resin and a vinyl resin.

It is preferable that the recording head perform recording by ejecting a fluorescent ink containing a compound that exhibits fluorescence as the ink.

It is preferable that the recording head perform recording by ejecting an ink containing a compound that changes color in response to environmental changes as the ink.

In this case, an endless belt is included that transports the recording medium by supporting the first surface of the tape-like recording medium on the support surface. That is, for example, it is possible for the tape-like recording medium to be attached to the adhesive surface of the endless belt, and for the movement of the endless belt to be tracked to the movement of the tape-like recording medium. Therefore, it is possible to transport a tape-like recording medium with high transport precision while suppressing bending and deformation thereof, and perform recording on the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1

Figure 1:
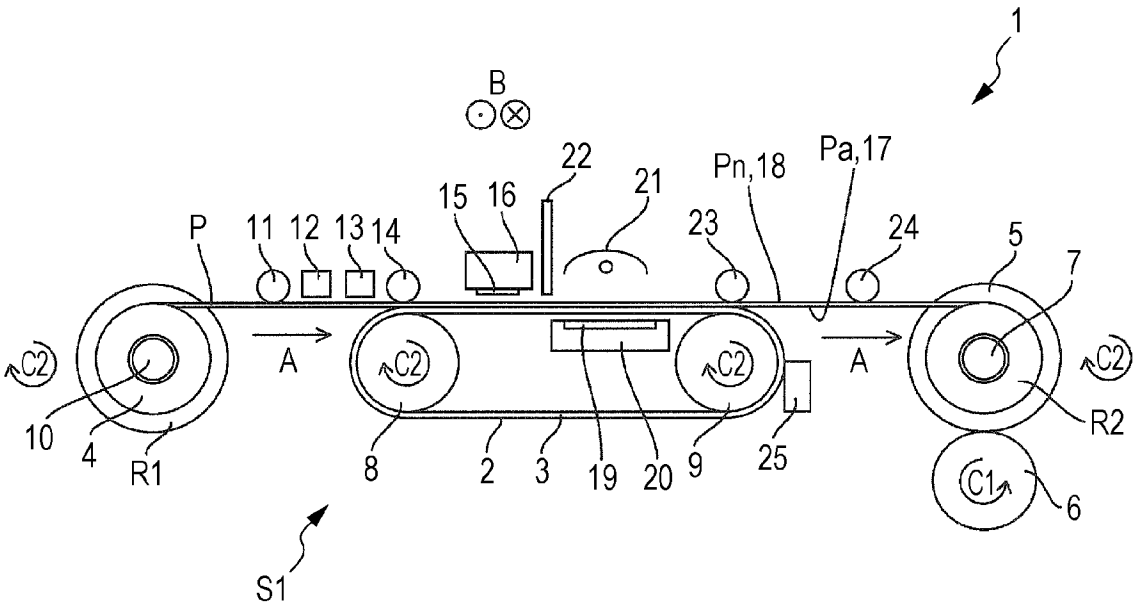
FIG. 1 is a schematic side view showing a recording apparatus according to Example 1 of the invention.
Figure 2A:
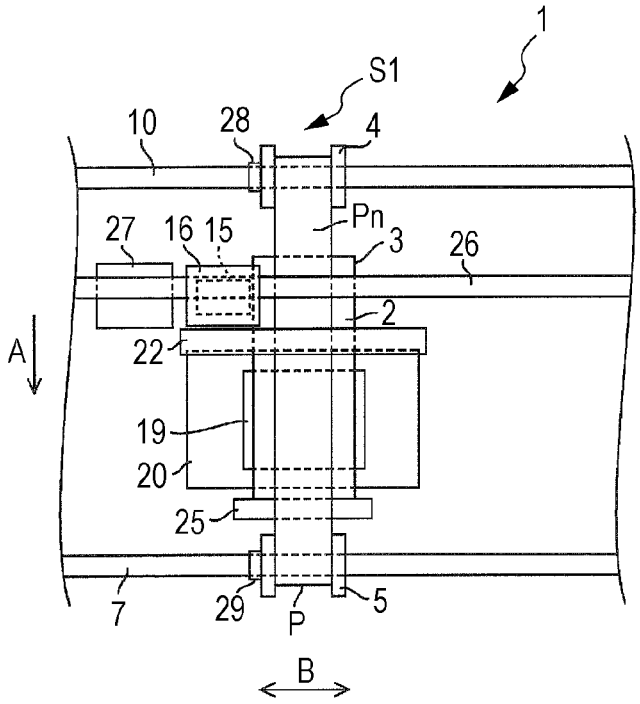
FIGS. 2A and 2B are schematic plan views showing the main portions of the recording apparatus according to Example 1 of the invention.
Figure 2B:
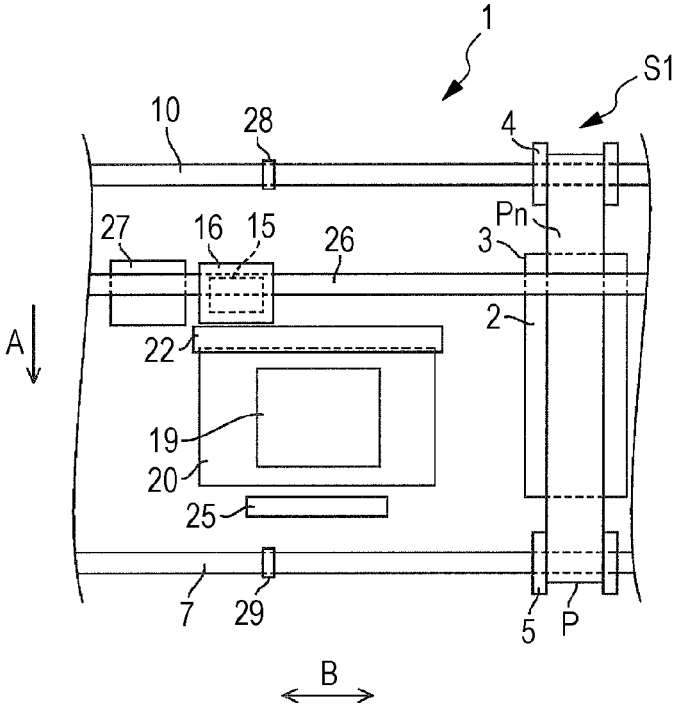
Figure 3:
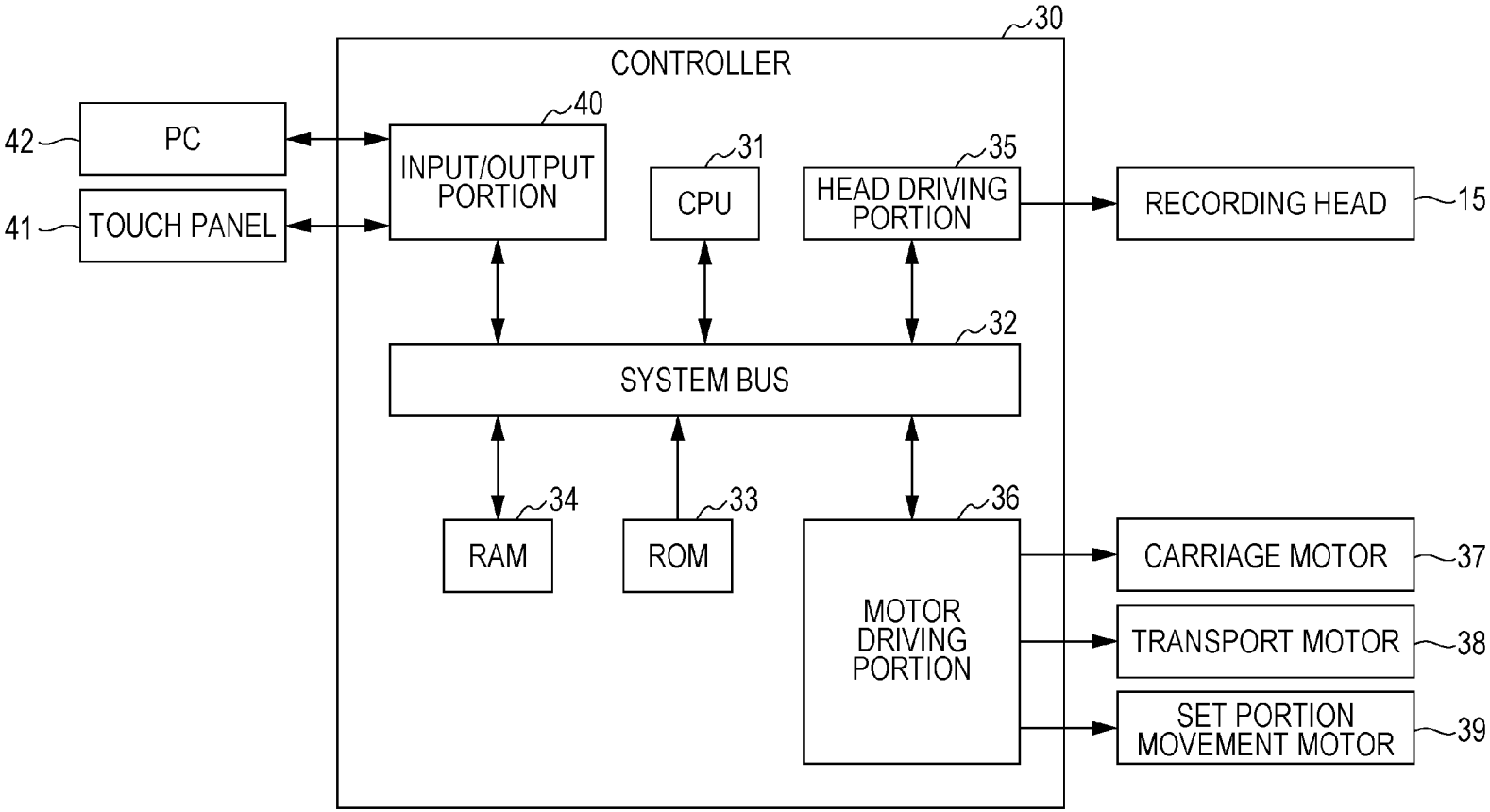
FIG. 3 is a block diagram of the recording apparatus according to Example 1 of the invention.

Refer to FIGS. 1 to 3

Below, the recording apparatus according to Example of the invention will be described in detail with reference to the attached drawings.

FIG. 1 is a schematic side view showing the recording apparatus 1 of the example.

In the following description of the recording apparatus 1 of the example, a case of performing recording with respect to a non-attachment surface Pn of the tape-like recording medium P wound into a roll shape having an attachment surface Pa coated with an adhesive and a non-attachment surface Pn not coated with an adhesive will be described. However, the recording apparatus 1 of the example is able to record on a recording medium having attachment surfaces on both sides, referred to as a so-called double-sided tape.

The recording apparatus 1 of the example includes an endless belt 3 that transports a recording medium P in a transport direction A by supporting the attachment surface Pa of the recording medium P with a support surface 2.

In the recording medium P, the surface of the side supported by the support surface 2 is the first surface 17, and the surface of the side on which the recording image is formed by ejecting ink from the recording head 15 and that is the surface of the opposite side to the first surface 17 is the second surface 18. In the example, the first surface 17 is the attachment surface Pa, and the second surface 18 is the non-attachment surface Pn.

The recording apparatus 1 includes a delivery portion 4 that delivers the recording medium P to the endless belt 3 from a roll R1, and a recovery portion 5 that winds up and recovers the recording medium P from the endless belt 3 using a roll R2.

A set portion S1 of the recording medium P is configured by the delivery portion 4, the endless belt 3, and the recovery portion 5.

The meaning of "a delivery portion that delivers the recording medium to the endless belt" also includes a configuration that unreels the recording medium to the endless belt by the delivery portion being driven, in addition to a configuration that unreels the recording medium to the endless belt by the delivery portion driving itself.

The arc surfaces of the recovery portion 5 and the driving roller 6 that rotates in the rotation direction C1 come into contact with each other, and the recovery portion 5 rotates in the rotation direction C2 around a second shaft 7 extending in a direction B that intersects the transport direction A as a rotary shaft.

The endless belt 3 is suspended on a driven roller and a driven roller 9 as a plurality of rotary bodies. The support surface 2 of the endless belt 3 is a non-adhesive surface; however, the recording medium P is supported in a state in which the first surface 17 (attachment surface Pa) of the recording medium P is attached to the support surface 2. Therefore, when the recovery portion 5 rotates in the rotation direction C2 in a state in which the recording medium P is supported on the set portion S1, the recording medium P is tensioned by the recovery portion 5, and the driven rollers 8 and 9 rotate in the rotation direction C2.

When the driven rollers 8 and 9 rotate in the rotation direction C2, the recording medium P is tensioned by the endless belt 3, the delivery portion 4 rotates in the rotation direction C2 around the first shaft 10 that extends in the direction B as a rotary shaft, and delivers the recording medium P to the endless belt 3.

The recording apparatus 1 of the example includes a guide roller 11 between the delivery portion 4 and the endless belt 3 in the transport path of the recording medium P in order to improve the transport precision of the recording medium P.

The recording apparatus 1 of the example includes a discharge portion 12 on the upstream side of the recording head 15 in the transport path of the recording medium P in order to discharge the recording medium P peeled and charged when the recording medium P is peeled from the roll R1 prior to printing.

Although the discharge portion 12 of the example uses an ionizer able to discharge the recording medium P without contacting the recording medium P, there is no limitation to an ionizer. For example, it is possible to use a discharge roller or a discharge brush in place of the ionizer.

In a case of using an ionizer as the discharge portion 12, an air blowing portion, such as a fan, may be provided in order to effectively send ions generated in the ionizer to the recording medium P.

The recording apparatus 1 of the example includes an oxidation treatment portion 13 that performs surface oxidation of the second surface 18 (non-attachment surface Pn) of the recording medium P on the upstream side of the recording head 15 in the transport path of the recording medium P.

There are cases of coating a stripper on the non-attachment surface Pn of the tape-like recording medium P that has a roll-shape, such as used in the example, in order to ease peeling of the recording medium P, and cases in which recording by ejecting ink to the non-attachment surface Pn is difficult. However, according to the recording apparatus 1 of the example, an oxidation treatment portion 13 that performs surface oxidation on the second surface 18 that is the non-attachment surface Pn is included. Therefore, it is possible to easily perform recording by ejecting ink on the non-attachment surface Pn.

The surface oxidation treatment of the recording medium P will be described.

As in the recording apparatus 1 of the example, it is preferable that the surface (second surface 18) of the side on which a recording image is formed by discharging ink from the recording head 15 be subjected to surface oxidation treatment, as necessary. This is in order to be able to achieve an improvement in the coating properties in an ink absorbing layer formed on the recording medium P due to the surface oxidation treatment or an improvement in adhesiveness with the base material. Specific examples of the surface oxidation treatment include treatment methods selected from so-called corona (discharge) treatment, frame processing, plasma treatment, glow discharge treatment, and ozone treatment, and corona treatment is preferable. The treatment amount in the case of corona treatment is 600 $J/m^2$ to 12000 $J/m^2$ (10 $W \cdot min/m^2$ to 200 $W \cdot min/m^2$), and preferably 1200 $J/m^2$ to 9000 $J/m^2$ (20 $W \cdot min/m^2$ to 180 $W \cdot min/m^2$). Since the effect of the corona discharge treatment is sufficiently obtained at 600 $J/m^2$ (10 $W \cdot min/m^2$) or more, and the effect of the treatment peaks beyond 12000 $J/m^2$ (200 $W \cdot min/m^2$), 12000 $J/m^2$ (200 $W \cdot min/m^2$) or less is sufficient.

The adhesive used on the attachment surface Pa of the tape-like recording medium P that has a roll shape will be described.

Examples of the adhesive used on the attachment surface Pa are not particularly limited, and a non-aqueous adhesive in which a rubber based resin, such as a natural rubber or a synthetic rubber, or a silicone resin is dissolved in a solvent, such as mineral oil, or an aqueous adhesive containing a water-soluble resin, such as an acrylic resin or a vinyl resin, and a known adhesive may be used.

The stripper used on the non-attachment surface Pn of the tape-like recording medium P that has a roll shape will be described.

The stripper is preferably coated on the non-attachment surface Pn in order to peel the tape-like recording medium P that has a roll shape. There is demand for a stripper with appropriate stripping performance, high adhesiveness to a base material coated with the stripper, and is non-migratory to the adhesive.

Strippers are broadly classified as silicone-based and non-silicone based.

It is necessary to cure and adhere the silicone-based stripper when coated on the base material. Therefore, such strippers are further classified into thermosetting-types, irradiation curing-types, and others.

Examples of the thermosetting-type silicone-based stripper include addition reaction type silicone and condensation reaction silicone.

Examples of the irradiation curing-type silicone based stripper include UV curable-type silicone that cures by irradiation of ultraviolet rays, and electron beam curing-type silicone.

The non-silicone-based strippers are further classified into long chain alkyl polymers, polyolefin-based, fluorine-based, and others.

Among these, long chain alkyl polymers are mainstream. Examples of the long chain alkyl polymer include alkylated polymers, and long chain alkyl acrylate polymers. In particular, it is possible to preferably use a long chain alkyl polymer with 12 or more carbon atoms.

However, the recording medium P usable in the recording apparatus 1 of the example is not limited to a recording medium P in which such an adhesive is coated on the attachment surface Pa or a recording medium P in which such a stripper is coated on the non-attachment surface Pn.

The recording apparatus 1 of the example includes a pressure roller 14 at a position facing the driven roller 8 in the transport path of the recording medium P. By pressing the recording medium P to the endless belt 3 by the pressure roller 14 at a position facing the driven roller 8, it is possible to securely attach the first surface 17 of the recording medium P and the support surface 2, and securely support and transport the recording medium P with the support surface 2.

A recording head 15 is provided on the transport path of the recording medium P by the endless belt 3. The recording apparatus 1 forms a desired recording image on the second surface 18 by ejecting ink on the recording medium P from the recording head 15 while the recording head 15 is reciprocated in the direction B that intersects the transport direction A via the carriage 16.

Although the recording apparatus 1 of the example includes a recording head 15 that performs recording while reciprocating, the recording apparatus may include a so-called line head in which a plurality of nozzles that eject ink in the direction B that intersects the transport direction A.

The "line head" is a recording head in which a nozzle region formed in the direction B that intersects the transport direction A of the recording medium P is provided so at to be able to cover the entire direction B of the recording medium P, and is used in a recording apparatus that forms an image by fixing one of the recording head or the recording medium P and moving the other. The nozzle region in the direction B of the line head may also not be able to cover the entire direction B of the recording medium P according to the recording apparatus.

The recording apparatus 1 of the example, as above, includes an endless belt 3 that transports the recording medium P by supporting the first surface 17 of the tape-like recording medium P, in which the first surface 17 is the attachment surface Pa, with the support surface 2. The recording apparatus 1 includes a recording head 15 that performs recording by ejecting ink to the second surface 18 of the opposite side to the first surface 17 of the recording medium P transported by the endless belt 3.

That is, the recording apparatus 1 of the example attaches the attachment surface Pa of the tape-like recording medium P to the endless belt 3, and is able to track the movement of the endless belt 3 to the movement of the tape-like recording medium P. Therefore, it is possible to transport the tape-like recording medium P with high transport precision while suppressing bending and deformation.

The support surface 2 of the example suppresses excessive attachment of the support surface 2 to the first surface 17 that is the attachment surface Pa, since the support surfaces 2 is a non-adhesive surface. Therefore, the recording apparatus 1 of the example is able to reduce the stripping load between the support surface 2 and the first surface 17, and is able to transport the recording medium P with high transport precision.

In the recording apparatus 1 of the example as above, the endless belt 3 is suspended on a plurality of rotary bodies (driven rollers 8 and 9), and any of the plurality of rotary bodies is a driven roller.

However, at least one of the plurality of rotary bodies may be a driving roller, and the endless belt 3 may be configured to move due to the torque of the driving roller.

By using such a configuration, it is possible for the movement of the endless belt 3 to be more precisely tracked to the movement of the tape-like recording medium P. Therefore, it is possible to transport the tape-like recording medium P with high transport precision while suppressing bending and deformation.

The endless belt 3 of the recording apparatus 1 of the example as above is suspended on a plurality of rotary bodies. As shown in FIG. 1, the recording apparatus 1 of the example includes a heater 19 on the inner side of the endless belt 3 suspended on the plurality of rotary bodies. In the recording apparatus 1 of the example, as described later, the set portion S1 is able to move with respect to the constituent members inside the recording apparatus 1, in other words, the recording apparatus 1 of the example includes a heater 19 that heats between the plurality of rotary bodies.

In this way, since the heater 19 is provided on the inner side of the endless belt 3 suspended on the plurality of rotary bodies, it is possible to effectively utilize the space of the recording apparatus 1, and size increases in the recording apparatus 1 are suppressed.

The heater 19 is provided in order to dry the ink ejected on the recording medium P from the recording head 15. Directions other than the upward direction that is the direction in which ink may be present are covered by a heat insulating material 20 in order that the heat generated by the heater 19 is efficiently transferred to the ink.

The recording apparatus 1 of the example includes an infrared heater 21 by which the ink is dried from the second surface 18 side of the recording medium P at a position facing the heater 19 in the transport path of the recording medium P. Therefore, the drying performance is improved compared to a recording apparatus with a configuration in which the ink is dried only from the first surface 17 side of the recording medium P by the heater 19.

The recording apparatus 1 of the example includes a heat insulating wall 22 (heat insulating material) between the recording head 15, and the heater 19 and the infrared heater 21 on the transport path of the recording medium P. Therefore, heat from the heater 19 and the infrared heater is transferred to the recording head 15, and drying of the ink ejected from the recording head 15 is suppressed.

The recording apparatus 1 of the example includes a pressure roller 23 at a position facing the driven roller 9 in the transport path of the recording medium P. By pressing the recording medium P to the endless belt 3 by the pressure roller 23 at a position facing the driven roller 9, it is possible to securely attach the first surface 17 of the recording medium P and the support surface 2, and securely support and transport the recording medium P with the support surface 2.

The recording apparatus 1 of the example includes a guide roller 24 between the endless belt 3 and the recovery portion 5 in the transport path of the recording medium P in order to improve the transport precision of the recording medium P.

The recording apparatus 1 of the example includes a belt cleaning portion 25 able to clean ink or the like attached to the endless belt 3. A configuration that cleans the support surface 2 with an unwoven cloth or polyethylene terephthalate (PET) or a configuration that cleans the support surface 2 with a rotary-type cleaning brush may be used, without particular limitation, as belt cleaning portion 25. From the viewpoint of cleaning properties with respect to the support surface 2 and cost, a configuration that cleans the support surface 2 with an unwoven cloth or PET is preferable in a case in which the support surface 2 is a non-adhesive surface, and a configuration that cleans the support surface 2 with a rotary-type cleaning brush is preferable in a case in which the support surface 2 is an adhesive surface.

Next, the position of the set portion S1 when the recording medium P is set (during setting) on the set portion S1 of the recording apparatus 1 of the example will be described.

FIGS. 2A and 2B are schematic plan views showing the main portions of the recording apparatus 1 of the example. FIG. 2A shows the position of the set portion S1 during recording and FIG. 2B shows the position of the set portion S1 during setting.

In FIGS. 2A and 2B, for ease of understanding of the description, the driving roller 6, the guide roller 11, the discharge portion 12, the oxidation treatment portion 13, the pressure roller 14, the infrared heater 21, the pressure roller 23 and the guide roller 24 are not depicted.

As shown in FIGS. 2A and 2B, the set portion S1 of the recording apparatus 1 of the example is able to move in the direction B that intersects the transport direction A along the second shaft 7 to which the recovery portion 5 is attached and the first shaft 10 to which the delivery portion 4 is attached.

When the tape-like recording medium P is attached to the set portion S1, the user is able to move the set portion S1 to move to the position shown in FIG. 2B, and attach the recording medium P to the set portion S1.

In other words, the recording apparatus 1 of the example further includes the delivery portion 4 that delivers the recording medium P to the endless belt 3, and the recovery portion 5 that recovers the recording medium P from the endless belt 3, and is able to move the set portion S1 that has the delivery portion 4, the endless belt 3 and the recovery portion 5 relative to the constituent members inside the recording apparatus 1.

Therefore, the user is able to move the position of the set portion S1 from the position during recording shown in FIG. 2A during setting of the recording medium P to the recording apparatus 1. That is, the recording apparatus 1 of the example has improved operability during setting.

In the recording apparatus 1 of the example, the recording head 15 mounted to the carriage 16 during recording performs recording while reciprocating in the direction B along the third shaft 26. When recording is finished, the recording head moves to the upper portion of a maintenance box 27. That is, the upper portion of the maintenance box 27 corresponds to the home position of the recording head 15.

In the description, in other words, the recording apparatus 1 of the example includes the endless belt 3 that transports the recording medium P by supporting the tape-like recording medium P wound in a roll form with the support surface 2. The recording apparatus 1 includes the recording head 15 that performs recording by ejecting ink on the recording medium P transported by the endless belt 3. The recording apparatus 1 includes the delivery portion 4 that is attached to the first shaft 10 extending in the direction B that intersects the transport direction A of the recording medium M, and delivers the recording medium P to the endless belt 3 by rotating around the first shaft 10 as a rotary shaft. The recording apparatus 1 includes the recovery portion 5 that is attached to the second shaft 7 extending in the direction B that intersects the transport direction A of the recording medium P, and winds the recording medium P from the endless belt 3 by rotating around the second shaft 7 as a rotary shaft. The set portion S1 is able to move along the first shaft 10 and the second shaft 7 relative to the constituent members inside the recording apparatus 1.

Through such a configuration, the recording apparatus 1 of the example is able to move the position of the set portion S1 during setting of the recording medium P to the recording apparatus 1 from the position during recording, and the operability during setting is improved.

The heater 19 is provided on the transport path of the recording medium P during recording by the recording head 15, as shown in FIGS. 2A and 2B, and the recording apparatus 1 of the example is able to relatively move the set portion S1 in a direction separating from the heater 19 along the first shaft 10 and the second shaft 7.

Since the recording apparatus 1 of the example includes a heater 19, the drying speed of the ink ejected on the recording medium P is improved, and since the set portion S1 is relatively movable in the direction separating from the heater 19, it is possible to set the recording medium P once the set portion S1 cools.

The recording apparatus 1 of the example is provided with a stopper 28 on the first shaft 10. The position of the delivery portion 4 with respect to the first shaft 10 during recording by the recording head 15 is mechanically determined by the stopper 28.

In this way, in the recording apparatus 1 of the example, although the position of the delivery portion 4 with respect to the first shaft 10 during recording is mechanically determined, there is no limitation to such a configuration. For example, the position of the delivery portion 4 with respect to the first shaft 10 during recording may be electrically determined.

Examples of the position of the delivery portion 4 with respect to the first shaft 10 during recording being electrically determined include a case of the number of rotations of the motor being determined, or the like, in a case of a configuration in which the delivery portion 4 moves with respect to the first shaft 10 by the rotational driving of a motor.

By using such a configuration, it is possible to suppress the occurrence of transport defects due to the position of the delivery portion 4 shifting with respect to the first shaft 10.

The recording apparatus 1 of the example is provided with a stopper 29 on the second shaft 7. The position of the recovery portion 5 with respect to the second shaft 7 during recording by the recording head 15 is mechanically determined by the stopper 29.

In this way, in the recording apparatus 1 of the example, although the position of the recovery portion 5 with respect to the second shaft 7 during recording is mechanically determined, there is no limitation to such a configuration. For example, the position of the recovery portion 5 with respect to the second shaft 7 during recording may be electrically determined.

Examples of the position of the recovery portion 5 with respect to second shaft 7 during recording being electrically determined include a case of the number of rotations of the motor being determined, or the like, in a case of a configuration in which the recovery portion 5 moves with respect to the second shaft 7 by the rotational driving of a motor.

By using such a configuration, it is possible to suppress the occurrence of transport defects due to the position of the recovery portion 5 shifting with respect to the second shaft 7.

In the recording apparatus 1 of the example, the first shaft 10 is able to rotate with the delivery portion 4 fixed to the first shaft 10.

By using such a configuration, the recording apparatus 1 of the example has high transport precision with a simple configuration.

In the recording apparatus 1 of the example, the second shaft 7 is able to rotate with the recovery portion 5 fixed to the second shaft 7.

By using such a configuration, the recording apparatus 1 of the example has high transport precision with a simple configuration.

Next, the electrical configuration in the recording apparatus 1 of the example will be described.

FIG. 3 is a block diagram of the recording apparatus 1 of the example.

A CPU 31 that administers control of the entire recording apparatus 1 is provided in the controller 30. The CPU 31 is connected via a system bus 32 to the ROM 33 in which various control programs, maintenance sequences, or the like, executed by the CPU 31 are stored and a RAM 34 able to temporarily store data.

The CPU 31 is connected via the system bus 32 to the head driving portion 35 for driving the recording head 15.

The CPU 31 is connected via the system bus 32 to a motor driving portion 36 for driving each of the motors of a carriage motor 37 for causing the carriage 16 to move, a transport motor 38 that is the driving source for the driving roller 6, and a set portion movement motor 39 that is a driving source for the movement mechanism of the set portion S1 that causes the set portion S1 to move in the direction B as shown in FIGS. 2A and 2B.

The CPU 31 is connected via the system bus 32 to the input/output portion 40, and the input/output portion 40 is connected to a touch panel 41 provided in the recording apparatus 1, and that receives various instructions from the user, and a PC 42 that is an external device that inputs recording data or the like to the recording apparatus 1.

It is possible to use a configuration in which the controller 30 controls the number of rotations of the set portion movement motor 39 in a case of using a configuration in which the position of the delivery portion 4 with respect to the first shaft 10 during recording is electrically determined or a configuration in which the position of the recovery portion 5 with respect to the second shaft 7 during recording is electrically determined.

Next, the ink able to be preferably used in the recording apparatus 1 of the example will be described.

In the recording apparatus 1 of the example, it is possible to use various types of ink, such as a dye ink containing a dye as a coloring material, a pigment ink containing a pigment as the coloring material, or a clear ink without a coloring material, without particular limitation thereto.

It is possible to use a fluorescent ink containing a compound that exhibits fluorescence, an ink that contains a compound that changes color in response to environmental changes, an ink that contains a compound that loses color due to specified conditions. It is possible to use combinations of the inks listed above without limitation. By performing recording with these inks on the tape-like recording medium, the recording apparatus is useful in being able to simply create security labels, environmental change recording labels, and disappearing image labels. In the case of ink being recorded on the attachment surface, the image protection is also increased, and thereby much better.

Among such inks, it is possible to perform recording by ejecting, for example, a fluorescent ink containing a compound that exhibits fluorescence as the ink from the recording head 15.

For example, by using an ink that is invisible under ordinary conditions, and visible when irradiated with a specific wavelength as the fluorescent ink, and recording specific information with the ink, it is possible to suppress counterfeiting of the recording medium P.

Recording may be performed using both a fluorescent ink containing a compound that exhibits fluorescence and a colored ink containing a coloring material.

Among such inks, it is possible to perform recording by ejecting, for example, ink containing a compound that changes color in response to environmental changes as the ink from the recording head 15.

By using such an ink, it is possible to determine whether or not an article in which a recording medium P in which the ink is recorded and is bonded is placed in a specified environment (for example, temperature and humidity).

Recording may be performed using both an ink containing a compound that changes color in response to environmental changes and a colored ink containing a coloring material.

Among such inks, it is possible to perform recording by ejecting, for example, ink containing a compound that loses color due to specified conditions as the ink from the recording head 15.

Although a compound that loses color due to ultraviolet irradiation is given as an example of a "compound that loses color due to specified conditions", there is no limitation thereto.

By using such an ink, it is possible to cause a recording image to disappear on a recording medium P on which the ink is recorded in a case in which the recording image formed with the ink becomes unnecessary.

Recording may be performed using both an ink containing a compound that loses color due to specified conditions and a colored ink containing a coloring material.

It is possible to use the inks disclosed in JP-A-2012-126907, JP-A-2010-126566, JP-A-2008-95104, and JP-A-2012-31254 as examples of the fluorescent ink containing a compound that exhibits fluorescence.

It is possible to use the inks disclosed in JP-A-2005-291825, JP-A-2009-67863, JP-A-2009-185086, and JP-A-2010-247358 as examples of the ink containing a compound that changes color in response to environmental changes.

It is possible to use the inks disclosed in JP-A-2010-59233, JP-A-2012-219189, JP-A-2012-224789, and JP-A-2013-10812 as examples of the ink containing a compound that loses color due to specified conditions.

Next, the ink (below, also referred to as ink composition of the embodiment) able to be preferably used in the recording apparatus 1 of the example will be further described.

Ink Composition

The ink composition according to the present embodiment preferably includes a coloring material and a resin emulsion. More preferably, the coloring material is a pigment, and may further include wax particles.

Resin Emulsion

The ink composition according to the embodiment preferably further includes a resin emulsion. The resin emulsion exhibits an effect of excellent abrasion resistance of the recording image by the ink composition being sufficiently fixed on the recording medium P by forming a resin coating film. Due to the above effect, a recorded material recorded using an ink composition containing a resin emulsion has particularly excellent adhesiveness and abrasion resistance on a recording medium P that is non-absorbent or has low absorbency to ink.

The Tg of the resin emulsion is 50° C. or more and 150° C. or less, preferably 60° C. or more and 120° C. or less, and more preferably 70° C. or more and 100° C. or less. By the Tg being within the above ranges, the resin emulsions meeting one another is suppressed and the recording stability is superior, and the abrasion resistance of the recorded material is superior. The Tg may be measured using DSC, similarly to the melting point.

Examples of the resin emulsion include, but are not particularly limited to, for example, simple polymers or copolymers of (meth)acrylate, (meth)acrylic ester, acrylonitrile, cyanoacrylate, acrylamide, olefin, styrene, vinyl acetate, vinyl chloride, vinyl alcohol, vinyl ethyl, vinyl pyrrolidone, vinyl pyridine, vinyl carbazole, and vinyl imidazole, and vinylidene chloride, fluoride resins, and natural resins. Among these, at least one of a (meth)acrylic resin and a styrene-(meth)acrylate copolymer-based resin is preferable, at least one of an acrylic resin and a styrene-acrylate copolymer-based resin is more preferable, and a styrene-acrylate copolymer-based resin is still more preferable. The above copolymers may have the form of any of random copolymers, block copolymers, alternating copolymers, and graft copolymers.

A commercial product may be used as the resin emulsion, or a resin emulsion may be prepared using an emulsion polymerization method, or the like, as below. Examples of a method in which the resin in the ink composition is obtained in an emulsion state include a method in which a monomer of the water-soluble resin described above is emulsion polymerized in water in the presence of a polymerization catalyst and an emulsifier. The polymerization initiator, the emulsifier and the molecular weight regulator during emulsion polymerization may be used in accordance with methods known in the related art.

The average particle diameter of the resin emulsion is preferably in a range of 5 nm to 400 nm, and more preferably in a range 20 nm to 300 nm in order to significantly improve the storage stability and recording stability of the ink.

These resin emulsions may be used as one type singly, or two or more may be used in combination. Among the resins, the content of resin solids of the resin emulsion is preferably 0.1 mass % to 15 mass % with respect to the total mass (100 mass %) of the ink composition, and more preferably 0.5 mass % to 10 mass %. By the content being within the above ranges, it is possible to significantly improve the abrasion resistance and the recording stability of the recorded material.

Wax Particles

The ink composition of the embodiment may contain wax particles having a melting point of 50° C. or more and 170° C. or less. A coating with excellent surface slipperiness is formed using the wax particles. Therefore, a recorded material formed using the ink composition of the embodiment containing the above wax particles has excellent abrasion resistance.

The melting point of the wax particles is 50° C. or more and 170° C. or less, and more preferably 90° C. or more and 140° C. or less. By the melting point being within the above ranges, it is possible to obtain a recorded material with superior abrasion resistance. The melting point may be measured by differential scanning calorimetry (DSC). The melting point of the wax particles, for example, may be controlled by adjusting the ratio of the plurality of constituent units that configure the wax particles.

Although the type of wax particle is not particularly limited, it is preferable that at least one of polyethylene wax particles and polypropylene wax particles be included.

The addition amount of wax particles to the ink composition is preferably 0.1 mass % to 2.0 mass % with the total mass of the ink composition as a standard, and more preferably 0.2 mass % to 1.0 mass %. By the addition amount being within the above ranges, the abrasion resistance becomes superior.

The average particle diameter of the wax particles is preferably 0.02 μm to 0.5 μm, and more preferable 0.04 μm to 0.3 μm. By the average particle diameter being within the above ranges, the abrasion resistance becomes superior.

The average particle diameter in the invention of the present application is the average particle diameter of a volume standard measured by a laser diffraction and scattering methods, unless otherwise specified.

The mass ratio of the total solid content of the wax particles and the total solid content of the resin emulsion is preferably 1:5 to 5:2, more preferably 2:5 to 2:1, and still more preferably 1:2 to 3:2. By being in the above ranges, the mass ratio contributes to a recorded material with much superior abrasion resistance, deterioration of the abrasion resistance is further suppressed even during high temperature recording, and the recording stability is superior.

Alkyl Polyol with Standard Boiling Point of 280° C. or More

It is preferable that the ink composition of the present embodiment not substantially include an alkyl polyol with a standard boiling point of 280° C. or higher. The wording "not substantially include" indicates a predetermined component is not added exceeding an amount that sufficiently achieves the meaning of adding. The content of the alkyl polyol with a standard boiling point of 280° C. or higher in the ink composition with respect to the total mass of the ink composition is preferably 0 mass % or more and less than 1.0 mass %, more preferably 0 mass % or more and less than 0.5 mass %, still more preferably 0 mass % or more and less than 0.1 mass %, still more preferably 0 mass % or more and less than 0.05 mass %, still more preferably 0 mass % or more and less than 0.01 mass %, and most preferably 0 mass % or more and less than 0.001 mass %. By the content being within the above ranges, the abrasion resistance of the recorded material on which the ink composition is used is suppressed from lowering due to the alkyl polyol with a standard boiling point of 280° C. or higher, and it is possible to obtain a recorded material with superior abrasion resistance.

Aprotic Polar Solvent

The ink composition of the embodiment preferably further includes an aprotic polar solvent. By including the aprotic polar solvent, it is possible to suppress fixing of the pigment or the like, and the clogging resistance becomes excellent. There is an effect of the fixing properties being improved with respect to a recording medium of vinyl chloride, or the like. Examples of the aprotic polar solvent include, but are not particularly limited to, for example, dimethyl sulfoxide (DMSO), dimethyl formamide (DMF), hexamethylphosphoramide (HMPA), pyrrolidone-based solvents, lactones, and dioxane. The aprotic polar solvent may be used as one type singly, or two or more types may be used in combination.

By using a pyrrolidone-based solvent from among these, it is possible for the fixing properties of the ink composition to be further improved. Examples of the pyrrolidone-based solvent specifically include, but are not particularly limited to, N-methyl-2-pyrrolidone, N-ethyl-2-pyrrolidone, N-vinyl-2-pyrrolidone, 2-pyrrolidone, N-butyl-2-pyrrolidone, and 5-methyl-2-pyrrolidone. These may be only one type used singly, or two or more types may be used together.

The addition amount of the aprotic polar solvent to the ink is preferably 1.0 mass % to 30 mass %, more preferably 2 mass % to 25 mass %, and even more preferably 12 mass % to 25 mass % or less. By the addition amount being within the above ranges, the dispersion stability and compatibility of the wax and the resin component in the ink becomes superior.

Other Components

It is possible for the ink composition used in the embodiment to contain, a water-soluble resin, water, an organic solvent, a surfactant, an anti-foaming agent, a resin dispersant, glycol ethers, a pH adjuster, a fungicide, a rust inhibitor, a chelating agent or the like. When the ink composition used in the present embodiment contains these compounds, the characteristics thereof may be further improved in some cases.

Water-Soluble Resin

The ink composition according to the present embodiment preferably further includes a water-soluble resin. Examples of the water-soluble resin include, but are not particularly limited to, for example, fibrous resins such as acrylic resins, styrene acrylic resins, rosin modified resins, phenol resins, terpene resins, polyester resins, polyamide resins, epoxy resins, polyurethane resins, vinyl chloride vinyl acetate copolymer resins, and cellulose acetate butyrates; and vinyl toluene-α-methyl styrene copolymer resins. The water soluble resins may be used as one type singly, or two or more types may be used in combination. By including a water-soluble resin, the glossiness of the recording image is improved.

Water

The ink composition according to the embodiment preferably includes water. The water is the main medium of the ink composition and is a component to be evaporated and dispersed by drying. The water is preferably one in which ionic impurities have been removed such as a pure water or ultrapure water, such as ion-exchanged water, ultrafiltration water, reverse osmosis water, and distilled water. In addition, when water sterilized by ultraviolet irradiation, the addition of hydrogen peroxide, or the like, is used, it is possible to favorably prevent the occurrence of molds or bacteria in a case where a pigment dispersion and an ink composition using the same are stored for a long time. In a case of including water, the water content is preferably 50 mass % or more from the viewpoint of environmental characteristics and image drying characteristics.

Organic Solvent

The ink composition according to the embodiment may further include an organic solvent with a boiling point of 150° C. to 250° C. The organic solvent with a boiling point of 150° C. to 250° C. evaporates due to heating on the recording medium that is non-absorbent or has low absorbency to ink. Therefore, it is possible to fix the ink on the non-recording medium.

Examples of the organic solvent with a boiling point of 150° C. to 250° C. include, but are not particularly limited to, for example, propylene glycol, 1,3-propanediol, 1,2-butanediol, 1,3-butanediol, 1,4-butanediol, 1,2-pentanediol, 1,5-pentanediol, 1,2-hexanediol diol, and 1,6-hexanediol.

Example 2

Figure 4:
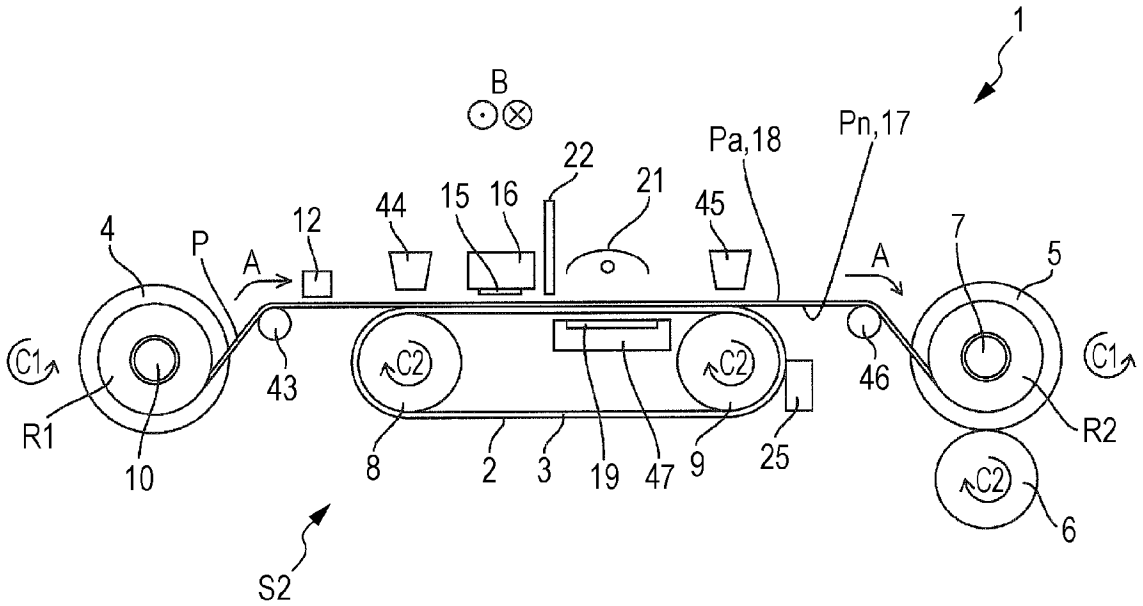
FIG. 4 is a schematic side view showing a recording apparatus according to Example 2 of the invention.

Refer to FIG. 4

Next, the recording apparatus of Example 2 will be described in detail with reference to the attached drawings.

FIG. 4 is a schematic side view of the recording apparatus 1 of the example. The constituent members common to the above examples are indicated by the same reference numerals, and detailed description thereof will not be made.

In the following description of the recording apparatus 1 of the example, a case of performing recording with respect to the attachment surface Pa of the tape-like recording medium wound into a roll shape having an attachment surface Pa coated with an adhesive and a non-attachment surface Pn not coated with an adhesive will be described. However, the recording apparatus 1 of the example is able to record on a recording medium having attachment surfaces on both sides, referred to as a so-called double-sided tape.

The recording apparatus 1 of the example includes an endless belt 3 that transports a recording medium P in a transport direction A by supporting the non-attachment surface Pn of the recording medium P with a support surface 2.

In the recording medium P, the surface of the side supported by the support surface 2 is the first surface 17, and the surface of the side on which the recording image is formed by ejecting ink from the recording head 15 and that is the surface of the opposite side to the first surface 17 is the second surface 18. In the example, the first surface 17 is the non-attachment surface Pn, and the second surface 18 is the attachment surface Pa.

The recording apparatus 1 includes a delivery portion 4 that delivers the recording medium P to the endless belt 3 from the roll R1, and a recovery portion 5 that winds up and recovers the recording medium P from the endless belt 3 using a roll R2.

A set portion S2 of the recording medium P is configured by the delivery portion 4, the endless belt 3, and the recovery portion 5.

The arc surfaces of the recovery portion 5 and the driving roller 6 that rotates in the rotation direction C2 come into contact with each other, and the recovery portion 5 rotates in the rotation direction C1 around a second shaft 7 extending in a direction B that intersects the transport direction A as a rotary shaft.

The endless belt 3 is suspended on a driven roller and a driven roller 9 as a plurality of rotary bodies. The support surface 2 of the endless belt 3 is an adhesive surface; however, the recording medium P is supported in a state in which the first surface 17 (non-attachment surface Pn) of the recording medium P is attached to the support surface 2. Therefore, when the recovery portion 5 rotates in the rotation direction C1 in a state in which the recording medium P is supported on the set portion S2, the recording medium P is tensioned by the recovery portion 5, and the driven rollers 8 and 9 rotate in the rotation direction C2.

When the driven rollers 8 and 9 rotate in the rotation direction C2, the recording medium P is tensioned by the endless belt 3, the delivery portion 4 rotates in the rotation direction C1 around the first shaft 10 that extends in the direction B as a rotary shaft, and delivers the recording medium P to the endless belt 3.

The recording apparatus 1 of the example includes a guide roller 43 between the delivery portion 4 and the endless belt 3 in the transport path of the recording medium P in order to improve the transport precision of the recording medium P.

The recording apparatus 1 of the example includes a discharge portion 12 on the upstream side of the recording head 15 in the transport path of the recording medium P in order to discharge the recording medium P peeled and charged when the recording medium P is peeled from the roll R1 prior to printing.

Although the discharge portion 12 of the example uses an ionizer able to discharge the recording medium P without contacting the recording medium P, there is no limitation to an ionizer. For example, it is possible to use a discharge roller in place of the ionizer. However, because the ionizer is able to discharge the recording medium P without contacting to the recording medium P, it is possible to preferably use the ionizer since it is possible to discharge, prior to printing, the recording medium P that is peeled and charged when the recording medium P is peeled without coming into contact with the second surface 18 that is the attachment surface Pa.

In a case of using an ionizer as the discharge portion 12, an air blowing portion, such as a fan, may be provided in order to effectively send ions generated in the ionizer to the recording medium P.

The recording apparatus 1 of the example includes a pressing portion 44 that presses the recording medium P to the endless belt 3 with wind power at a position facing the driven roller 8 with the endless belt 3 interposed. Therefore, it is possible to press the recording medium P to the endless belt 3, without contact, with wind power, securely attach the first surface 17 to the support surface 2, and transport the recording medium P securely supported with the support surface 2.

Although the recording apparatus 1 of the example includes a pressing portion that presses the recording medium P to the endless belt 3 with wind power as a pressing portion 44, a pressing portion with a configuration that presses the recording medium P to the endless belt 3 with a silicon roller may be included. Because the silicon roller does not easily attach to the attachment surface Pa of the recording medium P, it is possible to press the recording medium P to the endless belt 3, securely attached the first surface 17 to the support surface 2, and to transport the recording medium P securely transported with the support surface 2.

The recording apparatus 1 of the example includes a pressing portion 45 similar to the pressing portion 44 at a position facing the driven roller 9 in the transport path of the recording medium P. A guide roller 46 is included between the endless belt 3 and the recovery portion 5 on the transport path of the recording medium P.

Because the recording head 15, the carriage 16, the heat insulating material 20, the infrared heater 21, the heat insulating wall 22, and the belt cleaning portion 25 are the same as the recording apparatus 1 of Example 1, a detailed description thereof will not be made; however, the features of the example may be expressed as follows.

The heater 47 provided instead of the heater 19 in the recording apparatus 1 of Example 1 is a heater that heats to 60° C. or less.

The recording apparatus 1 of the example includes an endless belt 3 that transports the recording medium P by supporting the first surface 17 of the tape-like recording medium P on the 2 support surface; and the recording head 15 that performs recording by ejecting ink on the second surface 18 that is the attachment surface Pa on the opposite side to the first surface 17 of the recording medium P transported by the endless belt 3.

That is, the recording apparatus 1 of the example attaches the tape-like recording medium P to the adhesive surface of the endless belt 3, and is able to track the movement of the endless belt 3 to the movement of the tape-like recording medium P. Therefore, it is possible to transport the tape-like recording medium P with high transport precision while suppressing bending and deformation.

Because the support surface 2 of the example is an adhesive surface, it is possible to transport the recording medium P with the first surface 17 attached to the support surface 2. Therefore, it is possible to transport the tape-like recording medium P with high transport precision.

In the recording apparatus 1 of the example as above, the endless belt 3 is suspended on a plurality of rotary bodies (driven rollers 8 and 9), and any of the plurality of rotary bodies is a driven roller.

However, at least one of the plurality of rotary bodies may be a driving roller, and the endless belt 3 may be configured to move due to the torque of the driving roller.

By using such a configuration, it is possible for the movement of the endless belt 3 to be more precisely tracked to the movement of the tape-like recording medium P. Therefore, it is possible to transport the tape-like recording medium P with high transport precision while suppressing bending and deformation.

The endless belt 3 of the recording apparatus 1 of the example as above is suspended on a plurality of rotary bodies. As shown in FIG. 4, the recording apparatus 1 of the example includes a heater 47 that heats between the plurality of rotary bodies to 60° C. or less.

In this way, since the heater 47 is provided on the inner side of the endless belt 3 suspended on the plurality of rotary bodies, it is possible to effectively utilize the space of the recording apparatus 1, and size increases in the recording apparatus 1 are suppressed. Since the heater heats to 60° C. or less, drying and solidifying of the adhesive on the second surface 18 that is the attachment surface Pa released to the atmosphere is suppressed.

The recording apparatus 1 of the example, similarly to the recording apparatus 1 of Example 1, is able to move the set portion S2 configured by the delivery portion 4, the endless belt 3, and the recovery portion 5 relative to the constituent members inside the recording apparatus 1. Therefore, it is possible for position of the set portion S2 during setting of the recording medium P to the recording apparatus 1 of the example to move from the position during recording, and possible to improve the operability during setting.

The recording apparatus able to record on the attachment surface Pa of the recording medium P as in the recording apparatus 1 of the example preferably uses a recording medium P in which the adhesive contains at least one of an acrylic resin and a vinyl resin coated on the attachment surface Pa (second surface 18) of the recording medium P. Because the acrylic resin and the vinyl resin are water-soluble resins, it is possible to suppress lowering of the recording quality, in a case of recording using an aqueous ink on the acrylic resin and the vinyl resin. Therefore, it is possible to easily perform recording using aqueous ink with a low environmental load on the attachment surface Pa.

Example 3

Figure 5:
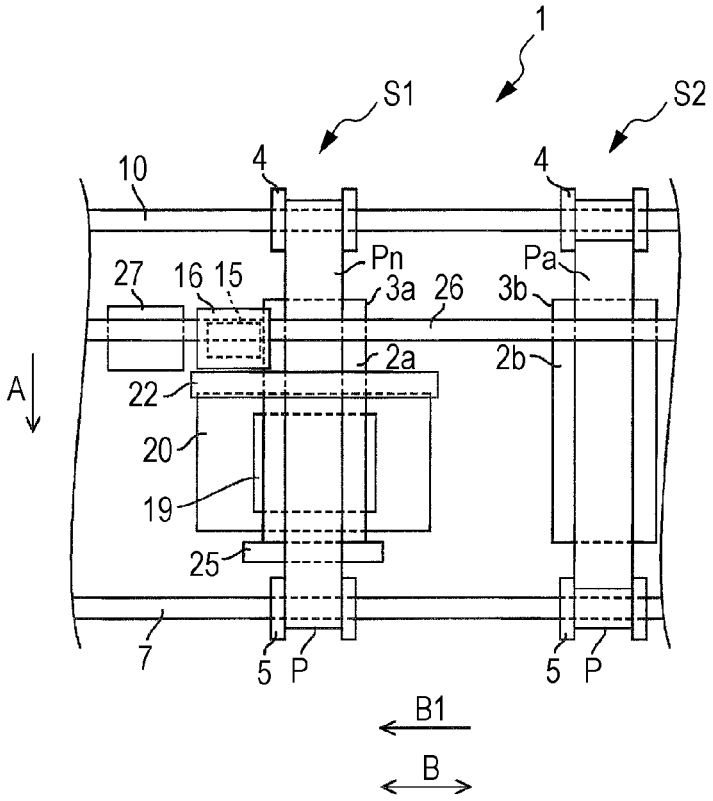
FIG. 5 is a schematic plan view showing the main portions of a recording apparatus according to Example 3 of the invention.

Refer to FIG. 5

Next, the recording apparatus of Example 3 will be described in detail with reference to the attached drawings.

FIG. 5 is a schematic plan view showing the main portions of a recording apparatus 1 of the example. The constituent members common to the above examples are indicated by the same reference numerals, and detailed description thereof will not be made.

FIG. 3 shows a block diagram of the electrical configuration in the recording apparatus 1 of the example, similarly to the recording apparatus 1 of Example 1.

The recording apparatus 1 of the example includes both the set portion S1 of the recording apparatus 1 of Example 1 and the set portion S2 of the recording apparatus of Example 2. The first support surface 2*a* that is a support surface of the set portion S1 supports the attachment surface Pa of the recording medium P, and the second support surface 2*b* that is a support surface of the set portion S2 supports the non-attachment surface Pn of the recording medium P.

The recording apparatus 1 of the example has a non-attachment surface recording mode that records on the non-attachment surface Pn of the recording medium P and an attachment surface recording mode that records on the attachment surface Pa of the recording medium P. A user is able to select the non-attachment surface recording mode and the attachment surface recording mode with at least one of the touch panel 41 and the PC 42.

When a user selects the non-attachment surface recording mode or the attachment surface recording mode with the touch panel 41 or the PC 42, the controller 30 receives the selection and controls the set portion movement motor 39 or the like so as to move the set portion corresponding to the selected recording mode to a position during recording.

FIG. 5 shows a state in which the non-attachment surface recording mode is selected by the user, and the set portion S1 is moved to the position during recording.

In a case in which the attachment surface recording mode is selected by the user, the recording apparatus 1 of the example is configured such that the set portion S2 reaches the position during recording by the set portion S1 and the set portion S2 moving together in the direction B1 of the direction B in FIG. 5.

In the above description, in other words, the recording apparatus 1 of the example includes the recording head 15 that performs recording by ejecting ink on the tape-like recording medium P having an attachment surface Pa and a non-attachment surface Pn. A first endless belt 3*a* is included that transports the recording medium P by supporting the attachment surface Pa of the recording medium P with the first support surface 2*a*. A second endless belt 3*b* is included that transports the recording medium P by supporting the non-attachment surface Pn of the recording medium P with the second support surface 2*b*. The recording apparatus 1 of the example has a non-attachment surface recording mode that records on the non-attachment surface Pn of the recording medium P and an attachment surface recording mode that records on the attachment surface Pa of the recording medium P, transports the recording medium P with the first endless belt 3*a* when recording in the non-attachment surface recording mode, and transports the recording medium P with the second endless belt 3*b* when recording in the attachment surface recording mode.

Therefore, the recording apparatus 1 of the example is able to record on both the attachment surface Pa and the non-attachment surface Pn with respect to the tape-like recording medium P having the attachment surface Pa and the non-attachment surface Pn.

The second support surface 2*b* of the recording apparatus 1 of the example is an adhesive surface. Therefore, it is possible to transport the recording medium P with the first surface 17 of the recording medium P that is the non-attachment surface Pn attached to the second support surface 2*b*, and to transport the recording medium P with high transport precision.

The first support surface 2*a* of the recording apparatus 1 of the example is a non-adhesive surface. Therefore, it is possible to suppress excessive attachment of the first support surface 2*a* to the first surface 17 of the recording medium P that is the attachment surface Pa. Therefore, it is possible to reduce the peeling load between the first support surface 2*a* and the first surface 17 of the recording medium P, and to transport the recording medium P with a high transport precision.

Although the first support surface 2*a* of the recording apparatus 1 of the example is a non-adhesive surface, even if the first support surface 2*a* is an adhesive surface with a weaker adhesiveness than the adhesiveness of the second support surface 2*b*, it is possible to suppress excessive attachment of the first support surface 2*a* to the first surface 17 of the recording medium P that is the attachment surface Pa. Therefore, it is possible to preferably use a first support surface 2*a* that is an adhesive surface with a weaker adhesiveness than the adhesive surface of the second support surface 2*b*.

The recording apparatus 1 of the example is able to use the roll-like recording medium P, similarly to the recording apparatus 1 of Example 1, and includes an oxidation treatment portion 13 that performs surface oxidation of the recording medium P, as shown in FIG. 1, on the upstream side of the recording head 15 in the transport path of the recording medium P. The oxidation treatment portion 13 is able to perform surface oxidation of the non-attachment surface Pn of the recording medium P when recording in the non-attachment surface recording mode. Meanwhile, when recording in the attachment surface recording mode, it is preferable that the surface oxidation treatment not be performed in order to prevent lowering of the adhesive power. Since the attachment surface is coated with an adhesive or the like, and functions such that the material absorbs the ink, fixing of ink is easier than on the non-attachment surface and it is difficult for defects to occur.

There are cases of coating a stripper or the like on the non-attachment surface Pn of the tape-like recording medium P that has a roll-shape, in order to ease peeling of the recording medium P, and cases in which recording by ejecting ink to the non-attachment surface Pn is difficult. However, since the recording apparatus 1 of the example includes the oxidation treatment portion 13 that performs surface oxidation on the non-attachment surface Pn, it is possible to easily perform recording by ejecting ink on the non-attachment surface Pn.

The recording apparatus 1 of the example includes, similarly to the recording apparatus 1 of Examples 1 and 2, the first endless belt 3*a* and the second endless belt 3*b* suspended on a plurality of rotary bodies, and a heater 19 that heats between the plurality of rotary bodies. The heater 19 is controlled by the controller 30 so as to heat the recording medium P when recording in the non-attachment surface recording mode, and to heat to a lower temperature than the heating temperature of the recording medium P in the non-attachment surface recording mode or to not heat the recording medium P when in the attachment surface recording mode. The reason is that since the attachment surface is coated with the adhesive or the like, and functions such that the material absorbs the ink, it is possible to reduce the load with respect to the recording medium P and the recording apparatus 1 by lowering the heating temperature at which the ink is more easily fixed than the non-attachment surface.

In this way, since the heater 19 is provided on the inner side of the endless belt suspended on the plurality of rotary bodies, it is possible to effectively utilize the space of the recording apparatus 1, and size increases in the recording apparatus are suppressed. The heater 19 is controlled by the controller 30 so as to heat the recording medium P when recording in the non-attachment surface recording mode, and to heat to a lower temperature than the heating temperature of the recording medium P in the non-attachment surface recording mode or to not heat the recording medium P when in the attachment surface recording mode. Therefore, drying and solidifying of the adhesive on the attachment surface Pa of the recording medium P released to the atmosphere is suppressed.

The recording apparatus 1 of the example includes, similarly to the recording apparatus 1 of Examples 1 and 2, the discharge portion 12 (ionizer), as shown in FIGS. 1 and 4, on the upstream side of the recording head 15 in the transport path of the recording medium P.

Because the ionizer is able to discharge the recording medium P without contacting to the recording medium P, it is possible for the recording apparatus 1 of the example to discharge, prior to recording, the recording medium P that is peeled and charged when the recording medium P is peeled without coming into contact with the attachment surface Pa.

As above, although the recording apparatus 1 of the example includes an ionizer as the discharge portion 12 on the upstream side of the recording head 15 in the transport path of the recording medium P, a discharge roller may be included instead of the ionizer. In particular, a configuration that includes a first discharge roller and a second discharge roller with a smaller contact area with the recording medium P than the first discharge roller, discharges the non-attachment surface Pn of the recording apparatus using the first discharge roller when recording in the non-attachment surface recording mode, and discharges the attachment surface Pa of the recording medium P using the second discharge roller when recording in the attachment surface recording mode is preferable.

According to such a configuration, it is possible to discharge, prior to recording, the peeled and charged recording medium P when the recording medium P is peeled, while reducing the contact area with the attachment surface Pa.

The recording apparatus 1 of the example is able to use a dye ink when recording in the attachment surface recording mode. Since the attachment surface is coated with an adhesive or the like, and functions such that the material absorbs the ink, it is possible to use a coloring material that is colored by infiltration to the interior, such as by the dye, as the coloring material of the ink. In addition to the dyes disclosed in the specification of the present application, it is possible to use any known dye.

The entire disclosure of Japanese Patent Application No. 2013-207082, filed Oct. 2, 2013 is expressly incorporated by reference herein.

What is claimed is:

1. A recording apparatus comprising:

an endless belt that transports a tape-shaped recording medium in a transport direction by supporting a first surface of the recording medium on a support surface;

a recording head that performs recording by ejecting an ink on a second surface on an opposite side to the first surface of the recording medium transported by the endless belt;

a delivery portion that delivers the recording medium to the endless belt;

a recovery portion that winds up and recovers the recording medium from the endless belt;

an ionizer that is provided at an upstream side of the recording head in the transport direction; and an oxidation treatment portion that is provided at the upstream side of the recording head in the transport direction.

2. The recording apparatus according to claim 1, wherein the support surface is an adhesive surface.

3. The recording device according to claim 1, wherein the endless belt is suspended on a plurality of rotary bodies, at least one of the plurality of rotary bodies is a driving roller, and the endless belt moves due to torque of the driving roller.

4. The recording apparatus according to claim 1, wherein the delivery portion, the endless belt, and the recovery portion are able to move relative to constituent members inside the recording apparatus.

5. The recording apparatus according to claim 1, wherein the endless belt is suspended on a plurality of rotary bodies, and includes a heater that heats between the plurality of rotary bodies to 60° C. or less.

6. The recording apparatus according to claim 1, wherein the endless belt is suspended on a plurality of rotary bodies, and includes a pressing portion that presses the recording medium to the endless belt with wind power or a silicon roller at a position that faces the rotary bodies with the endless belt interposed.

7. The recording apparatus according to claim 1, wherein an adhesive coated on the second surface contains at least one of an acrylic resin and a vinyl resin.

8. The recording apparatus according to claim 1, wherein the recording head performs recording by ejecting a fluorescent ink containing a compound that exhibits fluorescence as the ink.

9. The recording apparatus according to claim 1, wherein the recording head performs recording by ejecting the ink containing a compound that changes color in response to environmental changes.

10. The recording apparatus according to claim 1, further comprising:

a belt cleaning portion that cleans the endless belt.

* * * * *